US010837613B2

(12) United States Patent
Pellarin et al.

(10) Patent No.: US 10,837,613 B2
(45) Date of Patent: Nov. 17, 2020

(54) LIGHTING MODULE HAVING A FLEXIBLE MATRIX COINCIDING WITH THE FIRST OBJECT FOCAL SURFACE OF THE IMAGING DEVICE

(71) Applicant: VALEO VISION, Bobigny (FR)

(72) Inventors: Marie Pellarin, Bobigny (FR); Sebastien Roels, Bobigny (FR)

(73) Assignee: VALEO VISION, Bobigny (FR)

( * ) Notice: Subject to any disclaimer, the term of this patent is extended or adjusted under 35 U.S.C. 154(b) by 84 days.

(21) Appl. No.: 16/162,000

(22) Filed: Oct. 16, 2018

(65) Prior Publication Data

US 2019/0113199 A1 Apr. 18, 2019

(30) Foreign Application Priority Data

Oct. 16, 2017 (FR) ..... 17 59648

(51) Int. Cl.
*F21S 41/255* (2018.01)
*F21S 41/143* (2018.01)
(Continued)

(52) U.S. Cl.
CPC ..... *F21S 41/255* (2018.01); *F21S 41/143* (2018.01); *F21S 41/147* (2018.01); *F21S 41/153* (2018.01); *F21S 41/192* (2018.01); *F21S 41/26* (2018.01); *F21S 41/321* (2018.01); *F21S 41/322* (2018.01); *F21S 41/323* (2018.01);
(Continued)

(58) Field of Classification Search
CPC ..... F21S 41/143; F21S 41/255; F21S 41/192; F21S 41/153
See application file for complete search history.

(56) References Cited

U.S. PATENT DOCUMENTS 5,477,436 A * 12/1995 Bertling ..... F21V 5/002 362/545
5,570,951 A * 11/1996 Bertling ..... B60Q 1/00 362/231
(Continued)

FOREIGN PATENT DOCUMENTS

DE 20 2015 105 174 U1 10/2015
DE 10 2015 219 211 A1 4/2017
(Continued)

OTHER PUBLICATIONS

Mathias, European Patent Application publication EP2505910, Oct. 2012, machine translation (Year: 2012).*
(Continued)

*Primary Examiner* — Tracie Y Green
(74) *Attorney, Agent, or Firm* — Oblon, McClelland, Maier & Neustadt, L.L.P.

(57) ABSTRACT

A motor vehicle lighting module including: at least one matrix of light sources arranged in at least one horizontal row and in vertical columns, the light sources being emitting surfaces of light-emitting diodes which are all arranged on a common substrate; at least one imaging device designed to project the light sources, the imaging device including at least one first object focal surface having a curvature defect of determined radius of curvature; characterized in that the substrate has, in a horizontal plane, a curved form parallel to the first object focal surface of the imaging device.

20 Claims, 6 Drawing Sheets

(51) Int. Cl.

| | |
|---|---|
| ***F21S 41/147*** | (2018.01) |
| ***F21S 41/43*** | (2018.01) |
| ***F21S 41/663*** | (2018.01) |
| ***F21S 41/153*** | (2018.01) |
| ***F21S 41/32*** | (2018.01) |
| ***F21S 41/19*** | (2018.01) |
| ***F21S 41/26*** | (2018.01) |
| *F21Y 107/10* | (2016.01) |
| *F21Y 115/10* | (2016.01) |
| *F21Y 107/70* | (2016.01) |

(52) U.S. Cl.
CPC ..... *F21S 41/43* (2018.01); *F21S 41/663* (2018.01); *F21Y 2107/10* (2016.08); *F21Y 2107/70* (2016.08); *F21Y 2115/10* (2016.08)

(56) References Cited

U.S. PATENT DOCUMENTS

2001/0019486 A1 9/2001 Thominet
2004/0223328 A1* 11/2004 Lee ..... B60Q 1/2607 362/249.01
2015/0219298 A1* 8/2015 Mollers ..... F21S 41/19 362/520
2017/0073215 A1* 3/2017 Bergeron ..... B81C 1/00182
2019/0383474 A1* 12/2019 Vasylyev ..... G02B 6/0083
2020/0041093 A1* 2/2020 Pellarin ..... F21S 41/24

FOREIGN PATENT DOCUMENTS

EP 2 169 295 A1 3/2010
EP 2 505 910 A2 10/2012
WO 2016/194954 A1 12/2016

OTHER PUBLICATIONS

Albou et al. (Euorpean Patent Application EP2169295, machine translation (Year: 2010).*
Stefanove et al. German patent application publication, DE102015219211A1, Apr. 2017 (Year: 2017).*
French Preliminary Search Report dated Jul. 26, 2018 in French Application 17 59648 filed on Oct. 16, 2017 (with English Translation of Categories of Cited Documents).
Chinese Office Action dated Sep. 9, 2020, in Chinese Patent Application No. 201811202475.3 w/English translation, 17 pages.

* cited by examiner

LIGHTING MODULE HAVING A FLEXIBLE MATRIX COINCIDING WITH THE FIRST OBJECT FOCAL SURFACE OF THE IMAGING DEVICE

TECHNICAL FIELD OF THE INVENTION

The invention relates to the technical field of lighting modules for motor vehicle.

The invention relates more particularly to a motor vehicle lighting module comprising:

- at least one matrix of light sources arranged in at least one horizontal row and in vertical columns, the light sources being emitting surfaces of light-emitting diodes which are all arranged on a common substrate;
- at least one imaging device designed to project the light sources in a light beam in which each light source produces a light pixel, the activation of the light sources of a row forming a light row of light pixels lit uniformly, the imaging device comprising at least one first object focal surface exhibiting a curvature defect of determined radius of curvature.

TECHNICAL BACKGROUND OF THE INVENTION

Lighting modules of this type are already known. They are capable of emitting, longitudinally forwards, a segmented light beam. The lighting device comprises a matrix of elementary light sources which is projected forwards by an imaging device to form the segmented light beam in a matrix of light pixels. Each light pixel is lit by an associated light source. The light sources are capable of being activated individually and independently. By selectively switching on or switching off each of the elementary light sources, it is possible to create a light beam specifically lighting certain zones of the road in front of the vehicle, while leaving other zones in the dark.

Such a lighting optical module is used in particular to produce an adaptive lighting function, also called "ADB", the acronym for "Adaptive Driving Beam". Such an ADB function is intended to make it possible to automatically detect a user of the road likely to be dazzled by a lighting beam emitted in high beam mode by a headlight, and to modify the outrow of this lighting beam so as to create a shadow zone at the point where the detected user is located while continuing to light the road with a long range beam on either side of the user. The advantages of the ADB function are manifold: convenience of use, better visibility compared to lighting in low beam mode, risk of dazzle greatly reduced, safer driving, etc.

Such an optical module generally comprises a matrix of light sources, generally formed by light-emitting diodes (LEDs), and an imaging device. The light-emitting diodes are arranged on the surface of a planar substrate which extends in a plane orthogonal to the main direction of emission of the light-emitting diodes. Each light source is imaged by the projection optic to form a light pixel. Each light pixel is capable of being lit selectively by activation or deactivation of each light source.

Such an optical module is however likely to be subject to optical aberrations such as the aberration of sphericity, coma aberration, distortion aberration, astigmatism, field curvature aberration, etc.

The present invention relates more particularly to the solving of the problems posed by the field curvature aberration, also called "Petzval field curvature". Theoretically, the imaging device is assumed to have an object focal surface formed by a plane orthogonal to the optical axis of said optic. However, this object focal surface in reality has a concave spherical curvature.

Because of this, the light sources of the matrix being arranged in a plane orthogonal to the optical axis of the projection optic, only the secondary elementary light sources situated on the curved object focal surface are projected cleanly. The other light sources situated in front of or behind the curved object focal surface will be projected more or less fuzzily depending on their longitudinal distance relative to the object focal surface. The more distant the light source is from the object focal surface, the more fuzzy will be the associated light pixel.

The matrix of light sources generally has a horizontal dimension very much greater than its vertical direction. Thus, the light sources arranged at each end of a row are sufficiently distant from the object focal surface for the defect of curvature to have visible effects on the corresponding light pixels. The defect of curvature therefore has damaging effects on the horizontal rows of light pixels, whereas the effects on the vertical columns of light pixels are barely susceptible to the naked eye.

To solve this problem, it has already been proposed to interpose a primary optical element between the light sources and the imaging device. The primary optical element comprises, for example, light guides, each of which is associated with a light source. The output faces of the light guides are arranged on a curved surface moulding to the curvature of the real object focal surface of the projection optic. The imaging device then projects an image of the output faces of the light guides.

Since the light-emitting diodes are borne by a planar printed circuit board, the input faces of the light guides are arranged in one and the same plane. Because of this, the light guides situated transversely at a distance from the optical axis of the projection optic have a length greater than that of the light guides situated in proximity to said optical axis. Such a primary optical element is not easy to manufacture because of the variable lengths of the light guides.

Furthermore, the length of the light guides situated at the ends of the primary optical element is such that the choice of material to produce the primary optical element is limited for example to silicone. It is in particular very complex and extremely costly to produce the light guides in polycarbonate or in PMMA.

It has also been proposed to interpose an optical element for correcting the field curvature between the imaging device and the matrix of light sources.

However, such a solution once again necessitates adding an element to the lighting module. The manufacturing cost and the weight of the lighting module are then increased.

BRIEF SUMMARY OF THE INVENTION

The invention proposes a motor vehicle lighting module comprising:

- at least one matrix of light sources arranged in at least one horizontal row and in vertical columns, the light sources being emitting surfaces of light-emitting diodes which are all arranged on a common substrate;
- at least one imaging device designed to project the light sources in a light beam in which each light source produces a light pixel, the activation of the light sources of a row forming a light row of light pixels lit uniformly, the imaging device comprising at least one first object focal surface exhibiting a curvature defect of determined radius of curvature;

characterized in that the substrate has, in a horizontal plane, a curved form at least partly parallel to or coinciding with the first object focal surface of the imaging device.

Such a form of the substrate makes it possible to arrange each light source of a row at a single distance from the first object focusing surface of the imaging device. The result thereof is that the light pixels obtained by projection of the light sources of one and the same row exhibit substantially one and the same light intensity profile regardless of their position along the row. In particular, a light pixel situated at the end of the row will exhibit substantially the same distribution of light intensity as a light pixel situated in the middle of the row.

According to another aspect of the invention, the substrate which bears the matrix of light sources is flexible at least in a horizontal plane to adapt its radius of curvature to the radius of curvature of the first object focal surface.

Flexible should be understood to mean that the substrate can be curved under stress and that it reverts to its initial form when the stress is eliminated. In particular the substrate can revert to a planar form in its non-stressed state.

It is thus possible to adapt the radius of curvature of the substrate to the radius of curvature of the first object focusing surface of the imaging device. This makes it possible in particular to use one and the same module of matrix of light sources with different imaging devices. That also makes it possible to perfectly set the radius of curvature of the matrix to each imaging device.

As a variant, the substrate is also flexible in a vertical plane to form a portion of sphere after deformation.

According to another aspect of the invention, the imaging device comprises an input face for the light rays, the imaging device being designed for the first object focal surface to have a determined radius of curvature so that, in projection in a horizontal plane, the circle virtually prolonging said first object focal surface passes through the end edges of the input face for the light rays.

This very advantageously makes it possible to improve the light efficiency of the lighting module by increasing the light flux of the light sources emitted by the light sources situated at the end of a row through the imaging device.

According to a variant of the invention, the light sources are merged with the first object focal surface of the imaging device.

This variant is particularly advantageous when the light sources of one and the same row are substantially contiguous.

According to another aspect of the invention, the light sources are offset to the rear relative to the first object focal surface by a determined offset distance.

For example, the offset distance is defined in such a way that a cone whose base bears on the circumference of the input face of the imaging device and whose vertex is situated on the focus intercepts, in the extension of its vertex, a segment whose length is equal to the distance between the centre of two consecutive light sources of one and the same row.

This makes it possible to improve the light uniformity of the light beam emitted by the lighting module.

According to a first embodiment of the invention, the imaging device comprises a single object focal surface which is formed by said first object focal surface.

Such an imaging device is simpler to design.

According to a first variant of the first embodiment, the vertical distance separating two adjacent light sources of one and the same column is substantially equal to the horizontal distance separating two adjacent light sources of one and the same row such that, in the light beam, the light rows of light pixels overlap vertically.

According to a second variant of the first embodiment, the vertical distance separating two adjacent light sources of one and the same column is greater than the horizontal distance separating two adjacent light sources of one and the same row such that, in the light beam, the light rows of light pixels are distinct from one another with vertical interposition of darker separating rows.

According to this second variant, the invention relates also to a segmented light beam headlight for a motor vehicle which comprises two lighting modules each produced according to the invention, the rows of light pixels of one light beam being interposed between the rows of light pixels of the other light beam to create an overall uniform light beam.

According to a second embodiment of the invention, the imaging device comprises a second object focal surface, the first object focal surface focusing the light rays in a horizontal plane, and the second object focal surface focusing the light rays in a vertical plane, the lighting module comprising a primary optical element which forms the light rays emitted by the light sources to obtain vertically contiguous secondary light sources which are arranged coinciding with or in proximity to the second object focal surface.

This advantageously makes it possible to obtain a uniform light beam in which the light pixels overlap also vertically.

BRIEF DESCRIPTION OF THE FIGURES

Other features and advantages of the invention will become apparent from reading the following detailed description, for an understanding of which reference will be made to the attached drawings in which.

DETAILED DESCRIPTION OF THE FIGURES

Hereinafter in the description, elements that have an identical structure or similar functions will be denoted by one and the same reference.

Hereinafter in the description, there will be adopted, in a nonlimiting manner, a local reference frame linked to the lighting module having a longitudinal orientation, oriented from back to front and corresponding to the direction of normal displacement of the vehicle, vertical orientation, orientated from bottom to top, and transverse orientation, orientated from left to right, indicated by the trihedron "L, V, T" of the figures. The vertical orientation is used here as geometrical reference frame for the description of the lighting module, unrelated to the direction of gravity.

Furthermore, the vertical and transverse orientations are independent of a reference frame linked to the vehicle. As a nonlimiting example, in the example of FIG. 1, the transverse orientation extends from one wing to the other of the vehicle parallel to the road, whereas the vertical orientation extends orthogonally to the road, from the wheels to the roof of the vehicle. Nevertheless, it will be understood that the lighting module can also be arranged in the vehicle in such a way that the vertical and transverse orientations are pivoted about the longitudinal axis relative to the vehicle.

Figure 1:
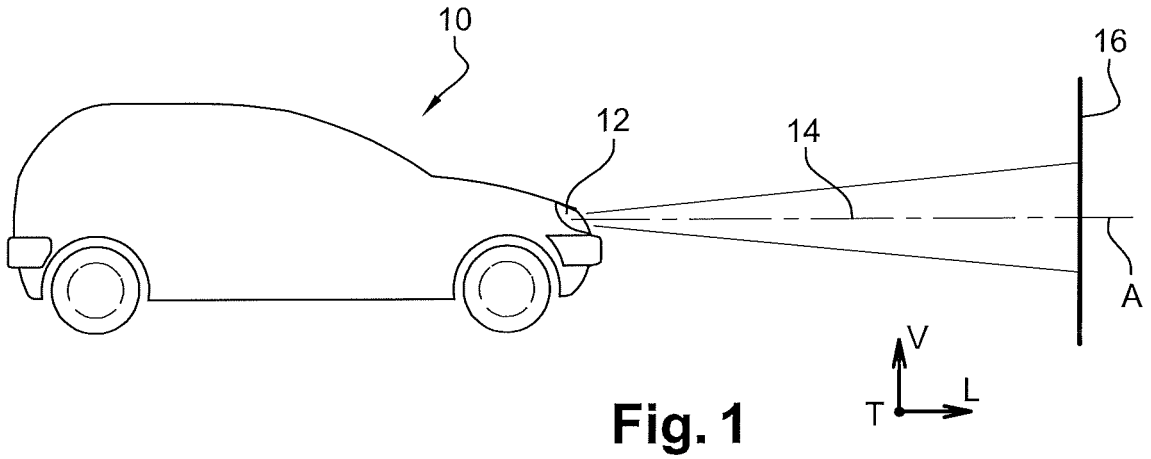
FIG. 1 is a side view which schematically represents a motor vehicle equipped with a lighting module produced according to the teachings of the invention which lights a transverse screen.

FIG. 1 shows a motor vehicle 10 equipped with a headlight 12 which produces a light beam 14 segmented into light pixels which produces a determined lighting function. In a nonlimiting manner, here, it concerns a high beam function. The longitudinal beam 14 is emitted along an axis "A" of emission that is substantially longitudinal to the front of the vehicle 10.

For the purposes of the description, a vertical transverse screen 16 has been arranged at a determined longitudinal distance in front of the vehicle 10. Here, the screen 16 is arranged at 25 m from the vehicle.

Figure 2:
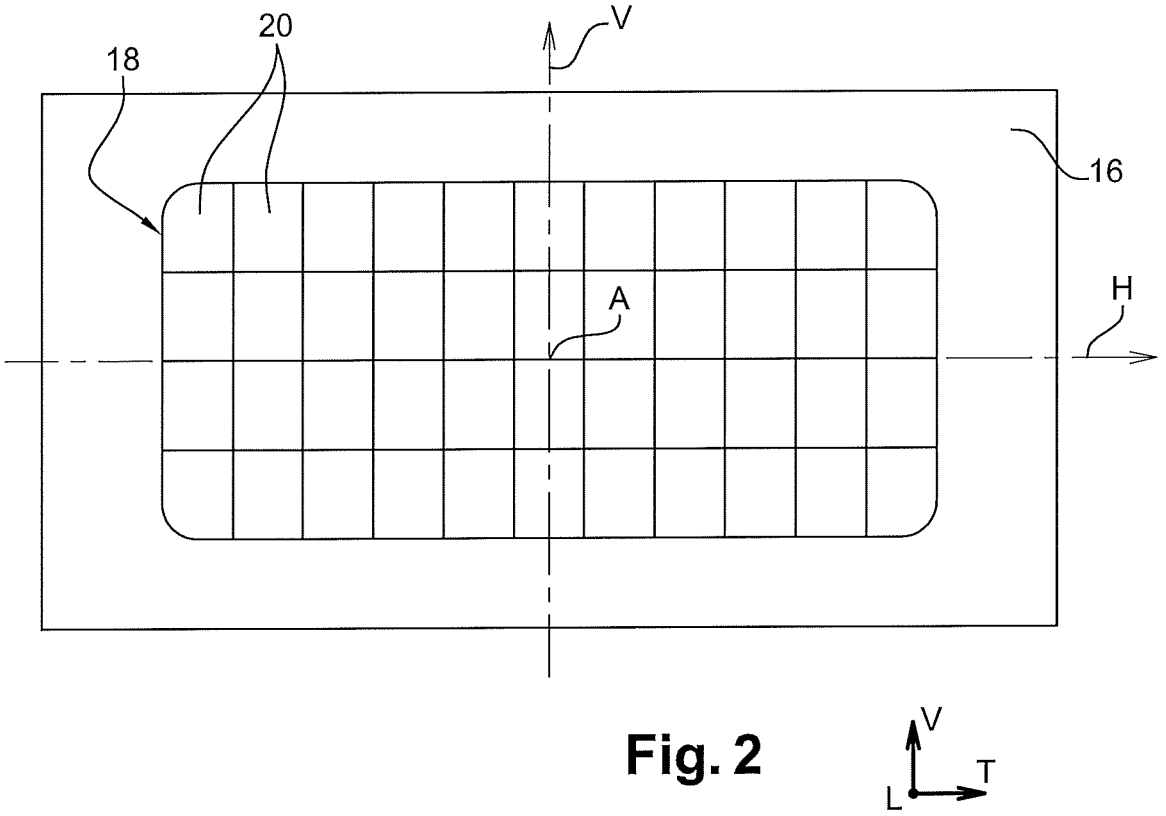
FIG. 2 is a front view which represents the screen lit by the light beam emitted by the lighting module of FIG. 1 which is segmented into several overlapping light pixels.

As represented in FIG. 2, a transverse axis "H" and a vertical axis "V" intersecting at the axis "A" of emission of the light beam 14 have been drawn on the screen 16. The axes "H" and "V" are graduated in degrees of aperture of the light beam.

The light beam 14 lights a zone 18 of the screen 16. This lit zone 18 is divided into a matrix of juxtaposed light pixels 20 which are arranged in transverse rows and in vertical columns. The light pixels 20 can be activated individually and independently of one another.

The term "juxtaposed" means that two vertically or transversely adjacent light pixels 20 overlap. Thus, when all the light pixels 26 are switched on, the light beam 14 lights the zone 18 of the screen 16 substantially uniformly. When a light pixel 20 is switched off, a portion of the space that it occupied on the screen 16 is not lit by the neighbouring pixels.

More particularly, each light pixel 20 has a bell-shaped light intensity profile along a cutting row. The overlap of two light pixels 20 is defined by the fact that the light profiles of two successive light pixels along a row, for example transverse, intersect.

Figure 3:
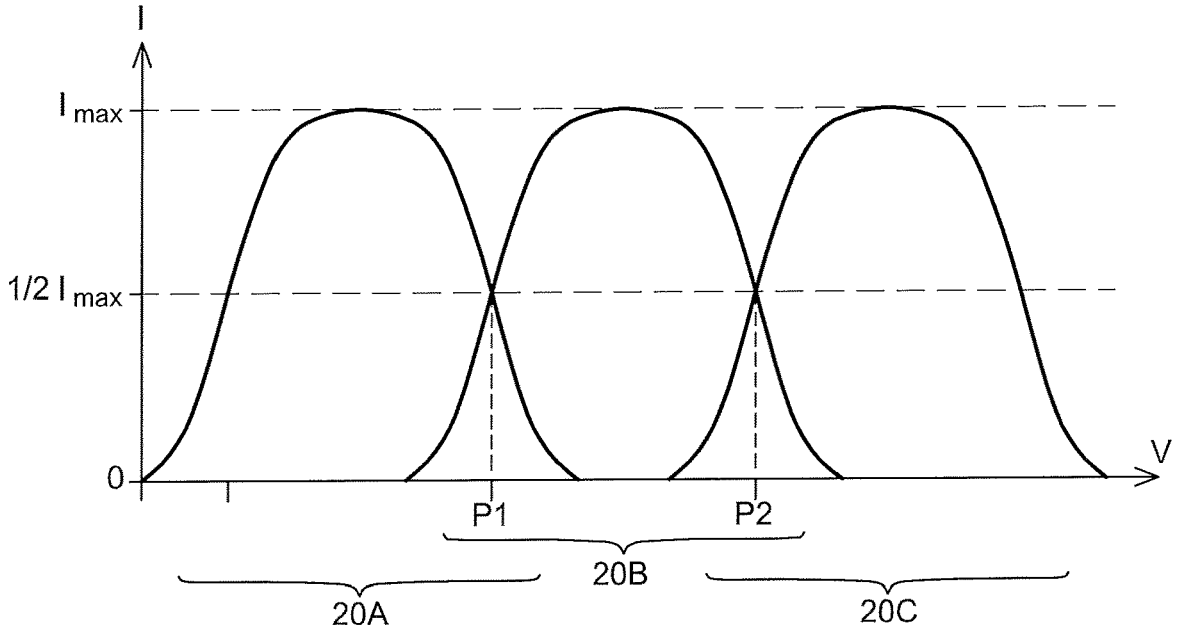
FIG. 3 is a diagram which represents the light intensity profile of three adjacent light pixels of the light beam as a function of their position on a transverse axis of the screen.

FIG. 3 gives a nonlimiting example of overlapping of the light pixels 20. FIG. 3 represents the light intensity profiles of three adjacent light pixels 20A, 20B, 20C projected onto the screen 16. Each light pixel 20A, 20B, 20C has a bell-shaped light intensity profile, the maximum light intensity Imax being situated at the centre of the light pixel 20A, 20B, 20C. As can be seen, the light pixel 20A on the left overlaps the central light pixel 20B so that the light intensity curves intercept at a point "P1" having a light intensity substantially equal to half the maximum light intensity Imax. Similarly, the light pixel 20C on the right overlaps the central light pixel 20B so that the light intensity curves intercept at a point "P2" having a light intensity substantially equal to half the maximum light intensity Imax. A central strip comprising the apex of the bell is lit only by the central light pixel 20B and this central strip is surrounded by strips lit in a degraded and less intense manner, which extend from the central strip respectively to the points P1 and P2.

As a variant of the invention that is not represented, each light pixel has a light profile approaching a slotted form in which the apex of the bell is spread to substantially form a plateau. In this case, the intersection between two light intensity profiles of two successive light pixels occurs at a light intensity less than half the maximum intensity.

According to another variant of the invention that is not represented, for example when the light sources are projected fuzzily, the space occupied by a determined light pixel is likely to be entirely lit by the adjacent light pixels. In this case, to obtain an entirely dark zone, it is necessary to switch off at least two adjacent pixels.

Figure 4:
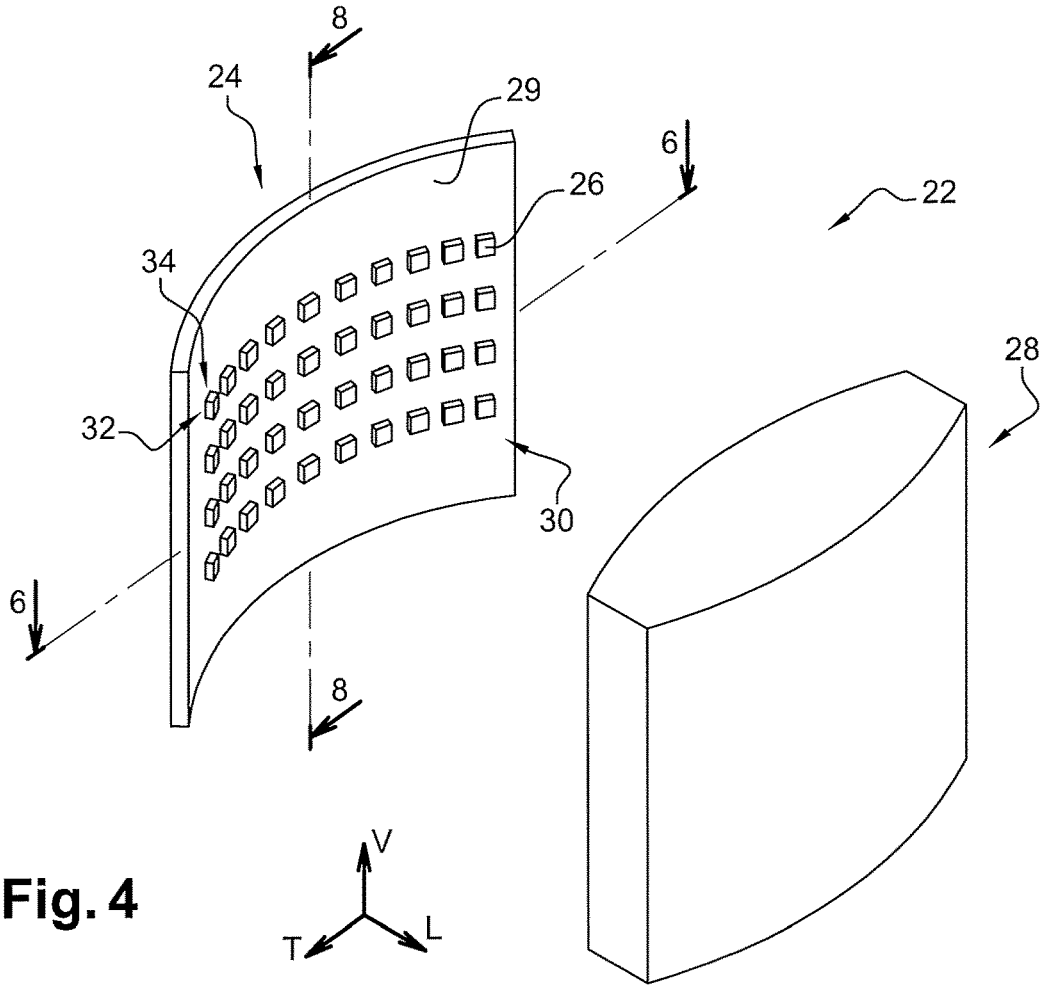
FIG. 4 is a perspective view which schematically represents the lighting module produced according to a first embodiment of the invention.

To produce such a light beam 14, the headlight 12 comprises at least one lighting module 22. As is for example represented in FIG. 4, the lighting module 22 comprises at least one matrix 24 of light sources 26 and at least one imaging device 28 which is designed to project the light sources by forming the light beam 14 in which each light source 26 produces a light pixel 20. The light sources 26 are, here, all identical in dimensions.

More particularly, the light sources 26 are formed by light emitting surfaces of light-emitting diodes. They are all arranged on a front face 29 of a common substrate 30. The common substrate 30 has the form of a plate which extends in an overall transverse vertical plane.

More particularly, all the light sources 26 are arranged in one and the same plane parallel to or coinciding with the face 29. For example, if the light-emitting diodes protrude from the face 29, they all protrude by the same distance.

The light sources 26 are arranged in horizontal rows 32 and in vertical columns 34. Here, the matrix 24 has a greater number of columns 34 than rows 32. In this way, the matrix has a transverse width very much greater than its vertical height.

Figure 5:
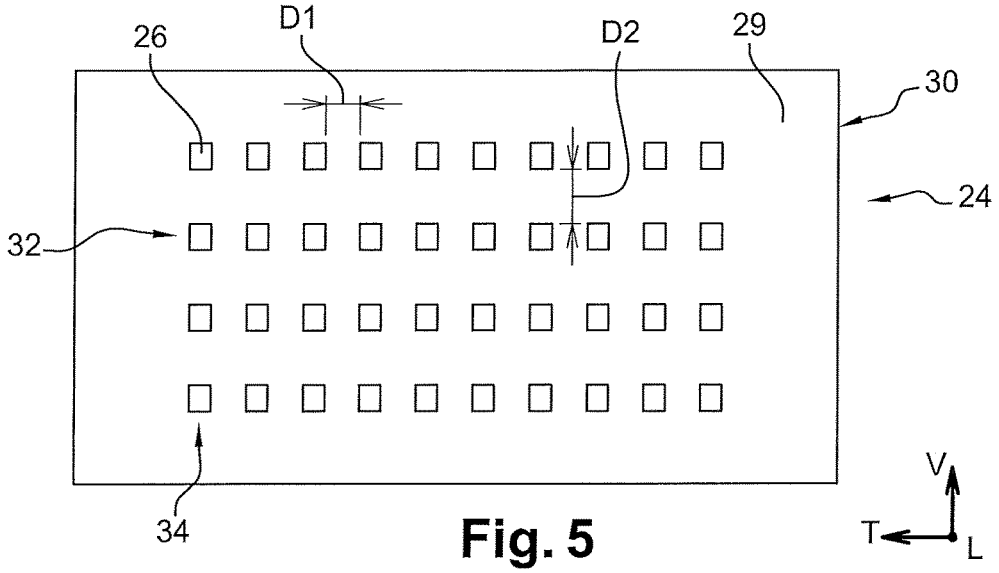
FIG. 5 is a front view which represents a matrix of light sources with which the lighting module of FIG. 4 is equipped.

In the embodiment represented in FIG. 5, two adjacent light sources 26 of one and the same row 32 are spaced apart by a first transverse distance "D1". Here, the transverse distance "D1" is the same for all the light sources 26 of one and the same row 32.

Similarly, two adjacent light sources 26 of one and the same column 34 are spaced apart by a second vertical distance "D2". Here, the vertical distance "D2" is the same for all the light sources of one and the same column 34.

The lighting module 22 comprises at least one imaging device 28 which is designed to project an image of each light source 26 substantially to infinity. The imaging device 28 is designed in particular to project the light sources 26 by forming the light beam 14 in which each light source 26 produces a light pixel 20.

In the embodiments represented in the figures, the imaging device 28 takes the form of a single lens. It will nevertheless be understood that the imaging device can also comprise at least one reflecting element and/or one or more lenses.

Generally, the imaging device 28 has an input face 36 for the light rays and an output face 38 for the light beam 14.

The imaging device 28 has at least one first focal length F1 and one first objet focal surface 40 that is overall transverse vertical which is arranged substantially coinciding with the light sources 26.

The first object focal surface 40 is in particular arranged in such a way that, when all the light sources 26 of a row 32 are activated, the screen 16 is lit uniformly by a corresponding light row of light pixels 20.

In normal use, the object focal surface 40 of the imaging device 30 is represented as a first approximation by an object focal surface 40 that is planar and perfectly orthogonal to the optical axis "A". However, in reality, it is known that the projection optic 14 has an object focal surface that has a defect of concave spherical curvature. Such a defect is called Petzval field aberration. The defect of curvature has a radius of curvature of determined radii of curvature. Thus, as represented for example in FIG. 6, in the sectional view along a horizontal cutting plane, the first object focal surface 40 appears as a circular arc.

For the light pixels 20 of one and the same row to exhibit a uniform sharpness, the invention proposes that the substrate 30 of the matrix 24 have, in a horizontal plane, a curved form at least partly parallel to the first object focal surface 40 of the imaging device 28. In particular, the part of the substrate 30 comprising the light sources 26 can have, in a horizontal plane, a curved form parallel to the first object focus surface 40 of the imaging device 28 whereas the ends of the substrate 30 situated on either side of the part of the substrate 30 comprising the light sources 26 can have, in this same horizontal plane, a form parallel or not to the first object focal surface 40 of the imaging device 28.

Figure 6:
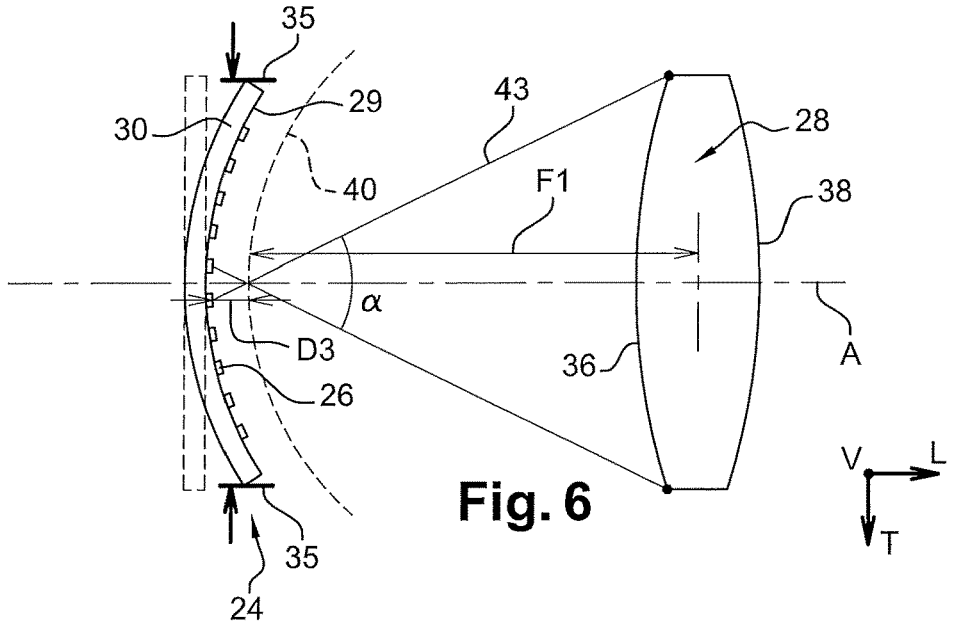
FIG. 6 is a view in transverse longitudinal cross section along the cutting plane 6-6 of FIG. 4 which represents the curved substrate of the matrix of light sources and the first object focusing surface of an imaging device of the lighting module.

According to an example represented in FIG. 6, all of the substrates 30 of the matrix 24 has, in a horizontal plane, a curved form parallel to the first object focal surface 40 of the imaging device.

The substrate 30 is thus curved so that its front face 29 has the form of a cylinder segment with vertical generatrices and with a base row in the form of a horizontal circular arc. The radius of curvature of the substrate 30 is determined in such a way that each row of light sources 26 is parallel with the object focal surface 40 taken on a horizontal cutting plane passing through said row 32. Thus, all the light sources 26 of one and the same row 32 are arranged at the same distance from the first object focal surface 40.

Advantageously, the substrate 30 which bears the matrix 24 of light sources 26 is flexible at least in a horizontal plane to accurately adapt its radius of curvature to the radius of curvature of the first object focal surface 40. The substrate 30 is for example elastically flexible, the front face 29 of the substrate 30 having a planar form in its non-stressed state, as is represented by broken rows in FIG. 6. This makes it possible to accurately adjust the radius of curvature of the substrate 30 to the defect of curvature of the associated imaging device 30.

Practically, the matrix 24 is mounted on a mount which makes it possible to adjust its radius of curvature. The mount comprises, for example, two gripping jaws 35 which are each arranged against a vertical edge of the substrate 30 and which transversely tighten the substrate 30 to stress it into the desired curved position.

In a variant that is not represented, the mount has a curved bearing surface against which a rear face of the substrate 30 is fixed, for example by gluing or by elastic fitting or by any other suitable fixing means.

When the transverse distance "D1" which separates two adjacent light sources 26 of one and the same row 32 is substantially nil, it is possible to make the first object focal surface 40 coincide perfectly with the light sources to obtain a uniform lighting of a row of corresponding light pixels 20. The light sources 26 are thus merged with the first object focal surface 40 of the imaging device 28.

Generally, the transverse distance "D1" between two adjacent light sources 26 of one and the same row 32 is not nil. For example, the transverse distance "D1" lies between 10% and 50% of the width of a light source 26. To make it possible to obtain a uniform lighting of the screen 16 by the corresponding row of light pixels 20, the object focal surface 40 is offset longitudinally forward by a longitudinal distance "D3" relative to the nearest light sources 26, as is represented in FIG. 6. This makes it possible to image the light source 26 by a light pixel 20 that is slightly fuzzy and more spread transversely which overlaps the adjacent pixels 20, thus making the dark spaces between two transversely adjacent light sources 26 disappear. In this case, the radius of curvature of the substrate 30 is equal to the sum of the radius of curvature of the first object focal surface 40 and of the longitudinal offset distance "D3".

In the embodiment represented in FIG. 6, the offset distance "D3" is defined in such a way that a cone 43 whose base bears on the circumference of the input face of the imaging device 28 and whose vertex is situated on the focus of the imaging device 28 intercepts, in the extension of its vertex, a segment whose length is equal to the distance between the centre of two consecutive light sources 26 of one and the same row 32. It will be noted that the aperture angle "α" of the cone 43 corresponds to the aperture angle of the imaging device 28.

Figure 7:
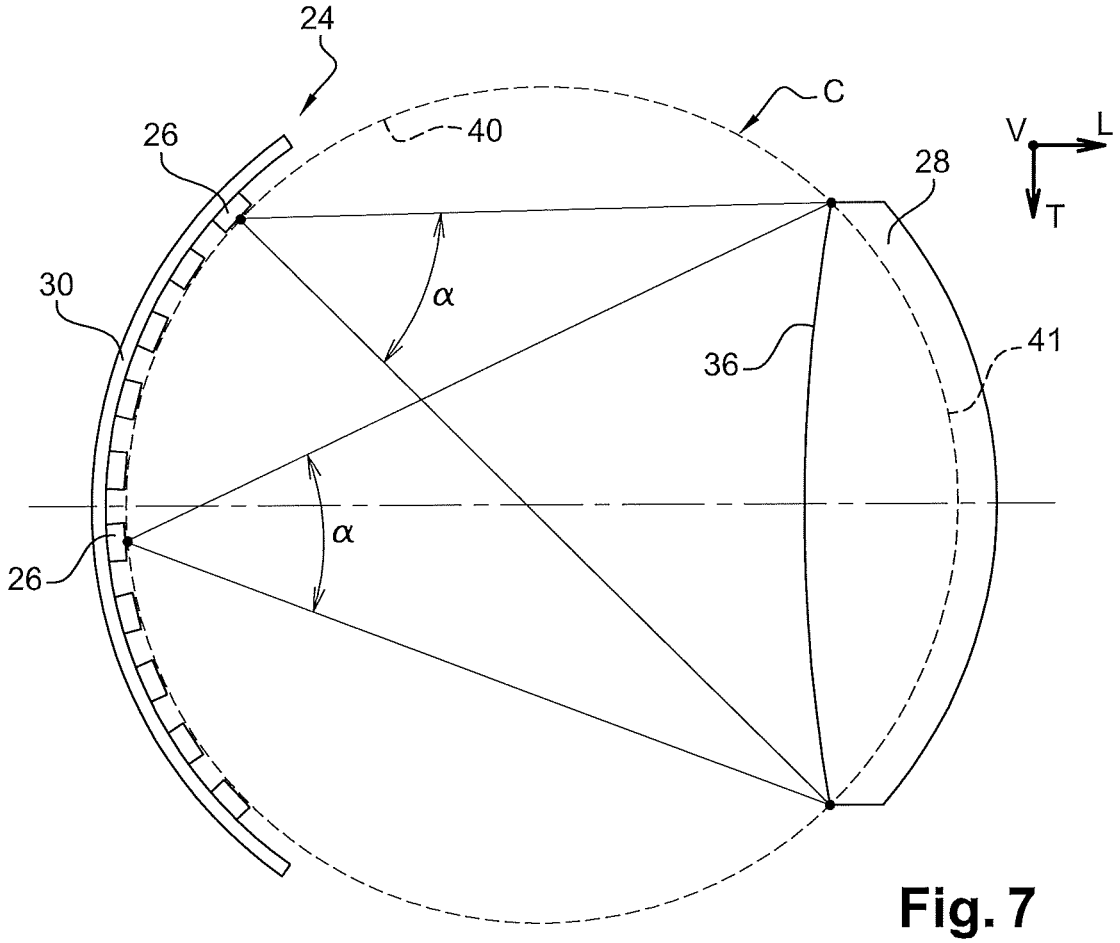
FIG. 7 is a view similar to that of FIG. 6 which represents a variant embodiment of the invention in which the first focusing surface has been extended by a circle passing through the end edges of the input surface of the imaging device.

According to another aspect of the invention, a virtual circle "C" is defined which is formed by extending the first object focal plane 40. The imaging device 28 is advantageously designed for the first object focal plane 40, in projection in an axial horizontal plane, to have a radius of curvature determined in such a way that the circle "C" passes through the end edges of the input face 36 for the light rays, as is illustrated in FIG. 7. Thus, the end edges of the input face 36 delimit an arc 41 of the circle "C". The so-called "inscribed angle" theorem states that an angle inscribed in the circle "C" which intercepts said arc 41 has the same value "α" whatever the position of its vertex on the circle "C". The angle "α" corresponds to the aperture angle of the imaging device 28.

In optical terms, and in the context of the invention, that means that the light flux produced by a light source 26, arranged in proximity to the first object focal surface 30, passing through the input face 36 of the imaging device 28, is substantially identical for all the light sources 26 of said row 32. This configuration thus makes it possible to very substantially improve the light efficiency of the light sources 26 arranged at the end of a row 32 compared to a lighting module in which the light sources are arranged on a planar substrate. This configuration also makes it possible to avoid the optical vignetting aberrations.

According to a first embodiment of the invention which is described with reference to FIGS. 4, 6, 7 and 8, the imaging device 28 comprises a single object focal surface which is formed by said first object focal surface 40.

The matrix 24 of light sources 26 is designed for the vertical distance "D2" separating two adjacent light sources 26 of one and the same column 34 to be substantially equal to the horizontal distance "D1" separating two adjacent light sources 26 of one and the same row 32. Thus, the light beam 14 lights the screen 16 in such a way that the light rows of light pixels 20 overlap vertically, in the same way as two light pixels 20 of the same row 32. The light beam 14 thus uniformly lights the screen 16.

Figure 8:
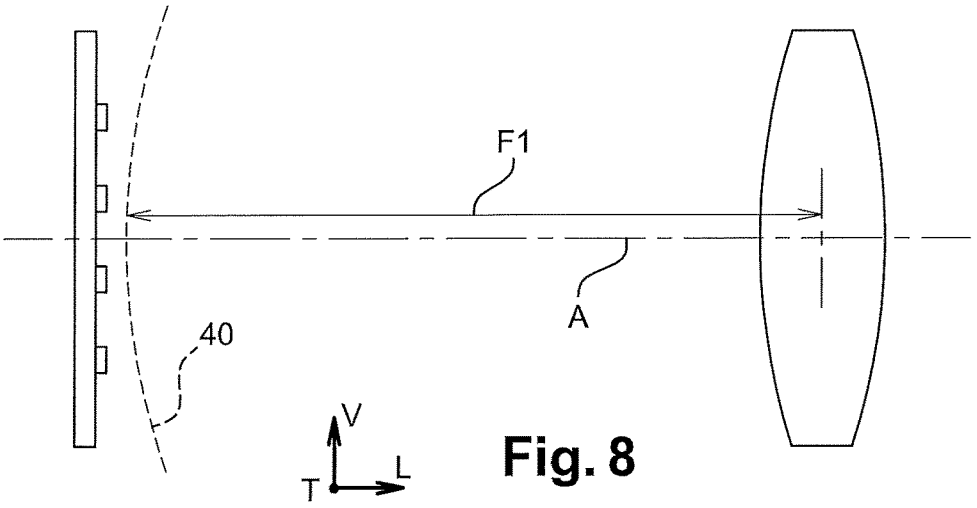
FIG. 8 is a view in longitudinal vertical cross section along the cutting plane 8-8 of FIG. 4.

As is represented in FIG. 8, when the substrate 30 is flexible only in a single plane, the matrix 24 has, in vertical axial cross section, a rectirowar form, whereas the first object focal surface 40 has the form of a circular arc. However, this configuration is not detrimental because, as was explained previously, the vertical dimension of the matrix 24 is very much smaller than its transverse dimension. Because of this, the fuzziness created by the field curvature effect is not perceptible to the naked eye on the light pixels 20 of one and the same column.

However, it is not always easy to obtain a matrix 24 having light sources that are also close together vertically.

Figure 9:
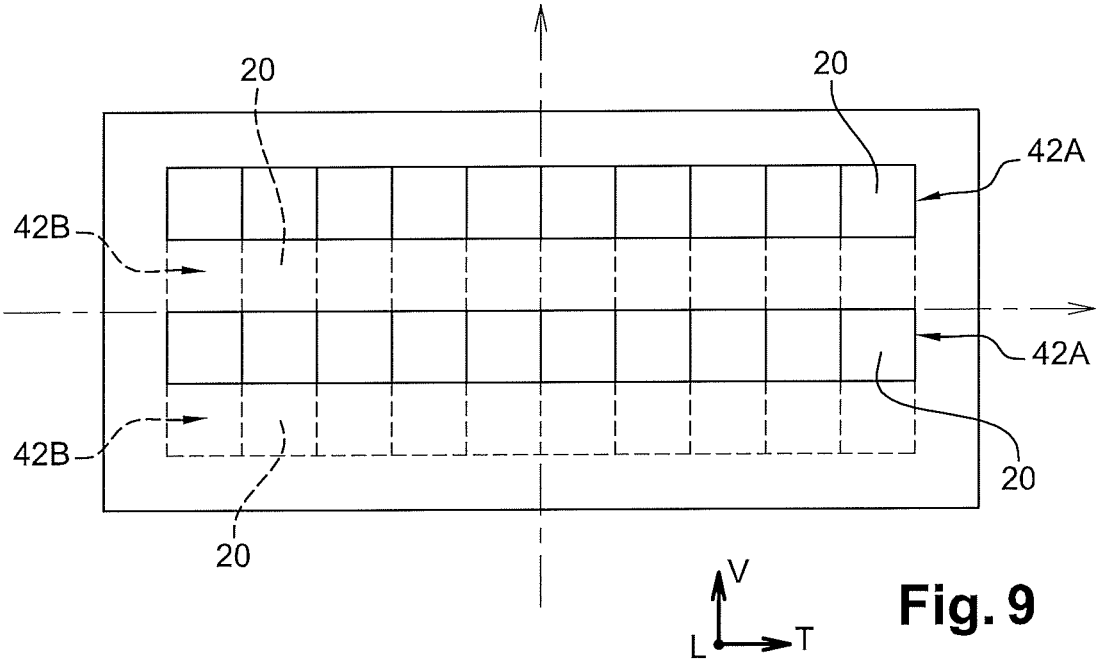
FIG. 9 is a front view similar to that of FIG. 2 in which the screen is lit by a headlight comprising two lighting modules produced according to a variant of the first embodiment of the invention.
Figure 10:
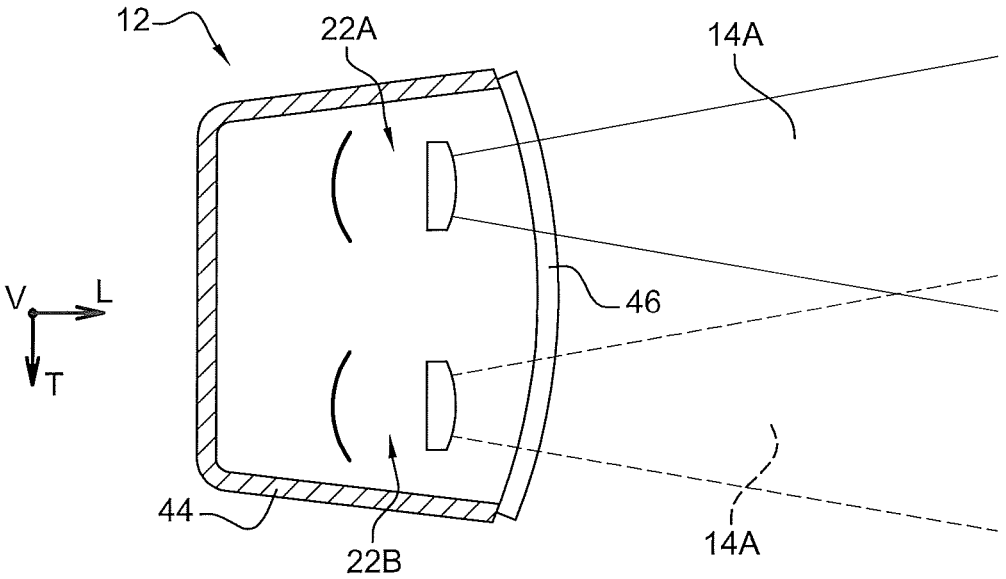
FIG. 10 is a view in transverse longitudinal cross section which schematically represents the headlight comprising the two modules which light the screen of FIG. 9.

To solve this problem, the invention proposes a variant of this first embodiment which is represented in FIGS. 9 and 10. The vertical distance "D2" separating two adjacent light sources 26 of one and the same column 34 is greater than the horizontal distance "D1" separating two adjacent light sources 26 of one and the same row 32 so that, in the light beam 14A, the rows 42A of light pixels 20 appear distinct from one another with the interposition of darker separating rows, as represented in FIG. 9.

To make it possible to obtain a uniform lighting of the screen 16, the headlight 12 then comprises two similar lighting modules 22A, 22B. The second lighting module 22B is arranged so as to project a light beam 14B having rows 42B of light pixels 20 between the rows 42A of light pixels of the other light beam 14A to create an overall uniform light beam.

Here, the two lighting modules 22A, 22B are arranged in one and the same headlight 12. The headlight 12 comprises a common housing 44 closed by an outer lens 46 enclosing the two lighting modules 22A, 22B.

Figure 11:
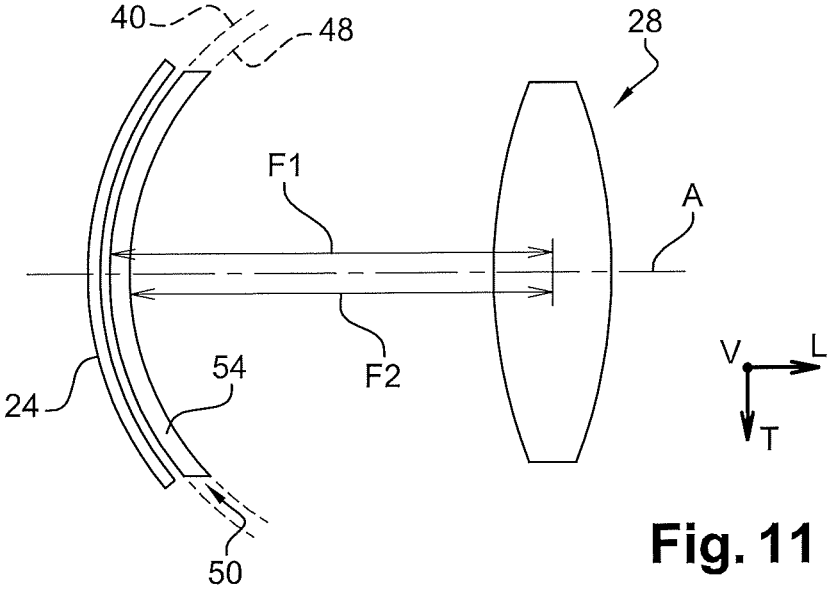
FIG. 11 is a view similar to that of FIG. 6 which represents a lighting module produced according to a second embodiment of the invention in which it comprises a primary optical element and in which the imaging device comprises two distinct object focusing surfaces.
Figure 12:
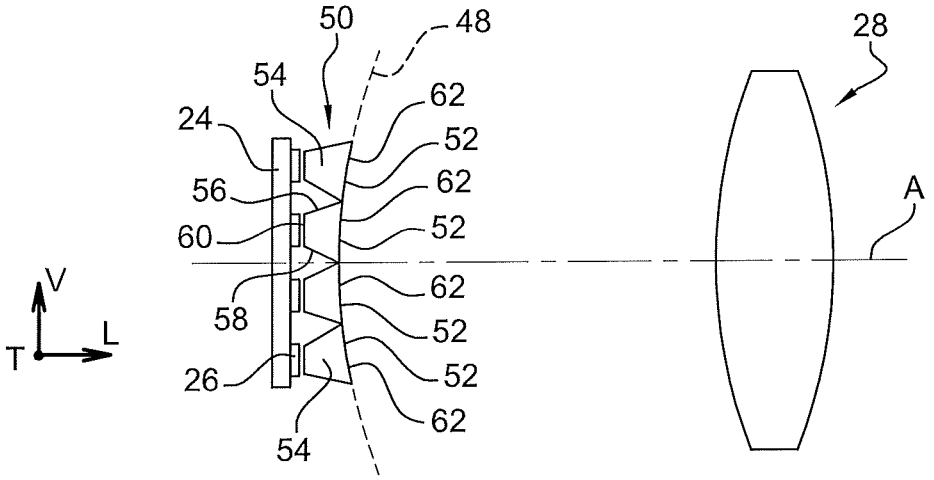
FIG. 12 is a view similar to that of FIG. 8 which represents the lighting module produced according to the second embodiment of the invention.

As a variant, to solve the problem posed when the vertical distance "D2" between the light sources 26 of the matrix 24 is too great, the invention proposes a second embodiment of the invention which is represented in FIGS. 11 and 12.

In this embodiment, the imaging device 28 is a bifocal device, sometimes also called astigmatic, which comprises, in addition to the first object focal surface 40, a second object focal surface 48. The second object focal surface 48 is arranged at a focal length "F2" relative to the optical centre of the imaging device 28.

The first object focal surface 40 focuses the light rays in a horizontal plane, whereas the second object focal surface 48 focuses the light rays in a vertical plane.

The lighting module also comprises a primary optical element 50 which forms the light rays emitted by the light sources 26 to obtain vertically contiguous secondary light sources 52 which are arranged on the second object focal surface.

The primary optical element 50 is an optical part, or a set of parts and/or optical structures, arranged to transfer the light emitted by said light sources 26 onto a virtual projection surface, which is situated facing and at a predetermined distance from the matrix 24, in the direction of the emission of the light, to form thereon the secondary light sources 52.

In the example represented in FIG. 12, the virtual surface is advantageously a virtual concave surface in the form of portion of sphere parallel to or merged with the second object focusing surface 48.

As a variant, the virtual projection surface can be a portion of cylinder parallel to the front face of the matrix 24.

Advantageously, each secondary light source 52 has a height greater than that of each associated light source 26. Thus, the secondary light sources 52 are, here, vertically contiguous.

Obviously, the primary optical element 50 can be produced in a single optical part but can comprise at least two optical parts which can have different forms and/or refractive indexes. Said at least two parts can also be manufactured in different materials and can comprise coatings to improve the light transmission efficiency, such as an anti-reflection coating. In order to optimize the efficiency and the quality of the beam projected by the lighting module, the primary element 50 can comprise diffractive or refractive structures, such as diffraction gratings or Fresnel structures.

In the embodiment represented in FIGS. 11 and 12, the primary optical element 50 comprises several light-guiding layers 54, each of which is arranged facing an associated row 32 of light sources 26.

A guiding layer 54 is defined as an optical part capable of guiding light by total internal reflection of this light, for example from an input face to an output face. A guiding layer 54 has a small thickness compared to its length and its width.

Thus, each guiding layer 54 has extensive top 56 and bottom 58 guiding faces separated by a perimeter. This perimeter defines a thickness of the guiding layer 56, which can be variable, for example increasing from one end to the other. The perimeter comprises a vertical transverse rear face 60 for light input common to all the light sources 26 of the associated row 32. The rear input face 60 is arranged in proximity to the associated light sources 26, for example at a few millimetres.

The light emitted by the light sources 26 which enters through the rear face 60 is propagated inside the guiding layer 60 by successive total internal reflections against the top and bottom faces 56, 58 towards a vertical transverse front output face 62. The front face 62 forms a portion of the perimeter of the guiding layer 54.

In the embodiment represented in the figures, the output face 62 of each guiding layer 54 has a height greater than that of its input face 60. Because of this, each guiding layer 54 has, in transverse longitudinal cross section, a divergent profile from its input face 60 to its output face 62.

The input face 60 has a height which is substantially equal to the height of the emission surface of the associated light sources 26.

The output face 62 is thus lit over all its height by the associated light sources 26, thus forming a row of secondary light sources 52.

The first object focusing surface 40 of the imaging device 28 is arranged in the same way as in the preceding embodiments, that is to say coinciding with or in proximity to the light sources 26. The second object focusing surface 48 is arranged substantially coinciding with the output faces 62 of the guiding layers 54.

Thus, for each light source 26 arranged substantially in proximity to the first object focusing surface 40, the light rays emitted by the emission surface of said light source 14 are projected in parallel by the imaging device 28 in longitudinal vertical planes, such that the light beam associated with said light source 26 creates a light segment of overall rectangular form delimited transversely by vertical edges which are the sharp image of the vertical edges of the emission surface.

Similarly, each light source 26 creates, on the output face 62 of the guiding layer 20, a secondary light source 52. Each secondary light source 52 is thus delimited vertically by two transverse edges which coincide with the edges formed by the top and bottom faces 56, 58 with the output face 62.

Since the output face 62 is arranged substantially coinciding with the second object focusing surface 48, the light rays emitted by each secondary light source are therefore projected parallel by the imaging device 28 in longitudinal transverse planes, such that the light beam associated with said light source 20 creates a light segment of overall rectangular form delimited vertically by vertical edges which are the sharp image of the transverse edges of the secondary light source 52.

Since the secondary light sources 52 are substantially contiguous, the pixels 20 obtained are also vertically contiguous.

For the same reasons of uniformity of the light beam 14, it will be possible to provide for the second object focal surface 48 to be offset slightly forward relative to the secondary light sources 52 to make it possible to obtain light pixels 20 which overlap slightly vertically, as explained previously.

Figure 13:
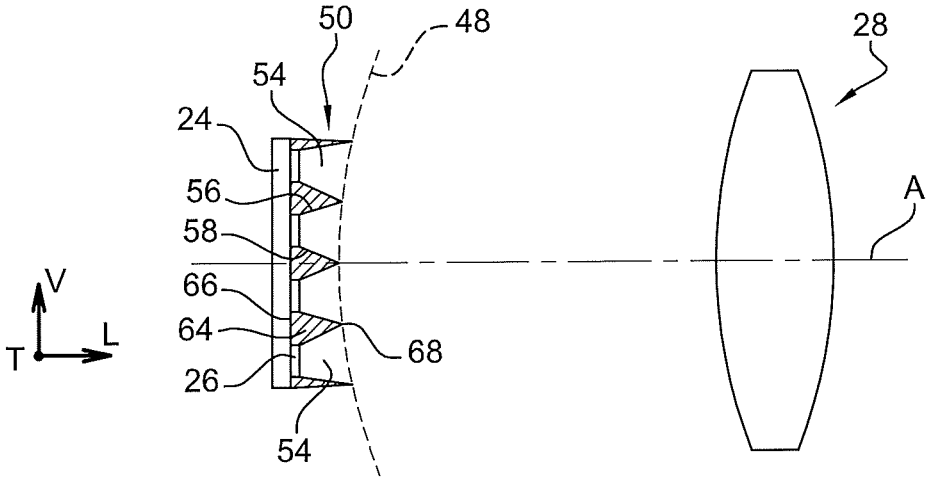
FIG. 13 is a view similar to that of FIG. 12 which represents a variant of the second embodiment of the invention.

In a variant of the invention represented in FIG. 13, the guiding layer is replaced by reflecting surfaces. In this case, the space which was occupied by the guiding layer of FIG. 12 is left empty, whereas the reflecting surfaces are borne by prisms 64 which extend longitudinally from their base 66 situated on the front face of the substrate 24, between two rows 32 to a free front transverse edge 68. The top 58 and bottom 56 faces of the prisms 64 form reflecting surfaces. The prisms fill precisely the voids between two guiding layers of FIG. 12. This embodiment operates in the same way as the embodiment of FIG. 12 and it makes it possible to obtain the same advantages.

By virtue of the lighting module produced according to any one of the embodiments described previously, the pixels obtained are sharper, particularly on the transverse edges of the zone lit by the light beam.

Furthermore, when the imaging device designed according to the other aspect of the invention such that the vertical sphere bearing the object focusing surface passes through the edges of its input face, the light efficiency of the lighting module is substantially improved compared to the known designs.

The invention claimed is:

1. Motor vehicle lighting module comprising:

at least one matrix of light sources arranged in at least one horizontal row and in vertical columns, the light sources being emitting surfaces of light-emitting diodes which are all arranged on a common substrate;

at least one imaging device designed to project the light sources in a light beam in which each light source produces a light pixel, the activation of the light sources of a row forming a light row of light pixels lit uniformly, the imaging device comprising at least one first object focal surface exhibiting a curvature defect of determined radius of curvature;

wherein the substrate has a planar form in a non-stressed state, and has, in a horizontal plane, a curved form at least partly parallel to or coinciding with the first object focal surface of the imaging device in a stressed state within the motor vehicle lighting module.

2. Lighting module according to claim 1, wherein the substrate which bears the matrix of light sources is flexible at least in a horizontal plane to adapt its radius of curvature to the radius of curvature of the first object focal surface.

3. Motor vehicle lighting module comprising:

at least one matrix of light sources arranged in at least one horizontal row and in vertical columns, the light sources being emitting surfaces of light-emitting diodes which are all arranged on a common substrate;

at least one imaging device designed to project the light sources in a light beam in which each light source produces a light pixel, the activation of the light sources of a row forming a light row of light pixels lit uniformly, the imaging device comprising at least one first object focal surface exhibiting a curvature defect of determined radius of curvature;

wherein the substrate has, in a horizontal plane, a curved form at least partly parallel to or coinciding with the first object focal surface of the imaging device;

wherein the imaging device comprises an input face for the light rays, the imaging device being designed for the first object focal surface to have a determined radius of curvature so that, in projection in a horizontal plane, the circle virtually prolonging said first object focal surface passes through the end edges of the input face for the light rays.

4. Lighting module according to claim 1, wherein the light sources are merged with the first object focal surface of the imaging device.

5. Motor vehicle lighting module comprising:

at least one matrix of light sources arranged in at least one horizontal row and in vertical columns, the light sources being emitting surfaces of light-emitting diodes which are all arranged on a common substrate;

at least one imaging device designed to project the light sources in a light beam in which each light source produces a light pixel, the activation of the light sources of a row forming a light row of light pixels lit uniformly, the imaging device comprising at least one first object focal surface exhibiting a curvature defect of determined radius of curvature;

wherein the substrate has, in a horizontal plane, a curved forma at least partly parallel to or coinciding with the first object focal surface of the imaging device;

wherein the light sources are offset to the rear relative to the first object focal surface by a determined offset distance.

6. Lighting module according to claim 5, wherein the offset distance is defined such a way that a cone whose base bears on the circumference of the input face of the imaging device and whose vertex is situated on the focus intercepts, in the extension of its vertex, a segment whose length is equal to the distance between the centre of two consecutive light sources of one and the same row.

7. Lighting module according to claim 1, wherein the imaging device comprises a single object focal surface which is formed by said first object focal surface.

8. Lighting module according to claim 7, wherein the vertical distance separating two adjacent light sources of one and the same column is substantially equal to the horizontal distance separating two adjacent light sources of one and the same row such that, in the light beam, the light rows of light pixels overlap vertically.

9. Lighting module according to claim 7, wherein the vertical distance separating two adjacent light sources of one and the same column is greater than the horizontal distance separating two adjacent light sources of one and the same row such that, in the light beam, the light rows of light pixels appear distinct from one another with vertical interposition of darker separating rows.

10. Lighting module according to claim 1, wherein the imaging device comprises a second object focal surface, the first object focal surface focusing the light rays in a horizontal plane, and the second object focal surface focusing the light rays in a vertical plane, the lighting module comprising a primary optical element which forms the light rays emitted by the light sources to obtain vertically contiguous secondary light sources which are arranged coinciding with or in proximity to the second object focal surface.

11. Headlight for segmented light beams for a motor vehicle, wherein the headlight comprises two lighting modules each produced according to claim 8, the rows of light pixels of one light beam being interposed between the rows of light pixels of the other light beam to create an overall uniform light beam.

12. Lighting module according to claim 2, wherein the imaging device comprises an input face for the light rays, the imaging device being designed for the first object focal surface to have a determined radius of curvature so that, in projection in a horizontal plane, the circle virtually prolonging said first object focal surface passes through the end edges of the input face for the light rays.

13. Lighting module according to claim 2, wherein the light sources are merged with the first object focal surface of the imaging device.

14. Lighting module according to a claim 2, wherein the light sources are offset to the rear relative to the first object focal surface by a determined offset distance.

15. Lighting module according to claim 2, wherein the imaging device comprises a single object focal surface which is formed by said first object focal surface.

16. Lighting module according to claim 2, wherein the imaging device comprises a second object focal surface, the first object focal surface focusing the light rays in a horizontal plane, and the second object focal surface focusing the light rays in a vertical plane, the lighting module comprising a primary optical element which forms the light rays emitted by the light sources to obtain vertically contiguous secondary light sources which are arranged coinciding with or in proximity to the second object focal surface.

17. Lighting module according to claim 3, wherein the light sources are merged with the first object focal surface of the imaging device.

18. Lighting module according to a claim 3, wherein the light sources are offset to the rear relative to the first object focal surface by a determined offset distance.

19. Lighting module according to claim 3, wherein the imaging device comprises a single object focal surface which is formed by said first object focal surface.

20. Lighting module according to claim 3, wherein the imaging device comprises a second object focal surface, the first object focal surface focusing the light rays in a horizontal plane, and the second object focal surface focusing the light rays in a vertical plane, the lighting module comprising a primary optical element which forms the light rays emitted by the light sources to obtain vertically contiguous secondary light sources which are arranged coinciding with or in proximity to the second object focal surface.

* * * * *